US010125972B2

(12) United States Patent
Alvarez Ruiz et al.

(10) Patent No.: US 10,125,972 B2
(45) Date of Patent: Nov. 13, 2018

(54) APPARATUS THAT PROVIDES AND EVAPORATION CYCLE OF A NATURAL CIRCULATION STEAM GENERATOR IN CONNECTION WITH A VERTICAL DUCT FOR UPWARD GAS FLOW

(71) Applicant: AMEC FOSTER WHEELER ENERGIA, S.L.U., Madrid (ES)

(72) Inventors: Francisco Javier Alvarez Ruiz, Las Rozas (ES); Francisco Pizarro, Las Rozas (ES)

(73) Assignee: Amec Foster Wheeler Energia, S.L.U., Las Rozas, Madrid (ES)

( * ) Notice: Subject to any disclaimer, the term of this patent is extended or adjusted under 35 U.S.C. 154(b) by 0 days.

(21) Appl. No.: 15/122,649

(22) PCT Filed: Mar. 21, 2014

(86) PCT No.: PCT/ES2014/070213

§ 371 (c)(1),
(2) Date: Aug. 31, 2016

(87) PCT Pub. No.: WO2015/140361

PCT Pub. Date: Sep. 24, 2015

(65) Prior Publication Data

US 2017/0067630 A1 Mar. 9, 2017

(51) Int. Cl.
*F22B 15/00* (2006.01)
*F22B 17/12* (2006.01)
(Continued)

(52) U.S. Cl.
CPC ..... *F22B 15/00* (2013.01); *F22B 17/12* (2013.01); *F22B 35/02* (2013.01); *F22B 17/00* (2013.01); *F22B 17/10* (2013.01)

(58) Field of Classification Search
CPC ..... F22B 15/00; F22B 17/12; F22B 35/02; F22B 17/00; F22B 17/10
(Continued)

(56) References Cited

U.S. PATENT DOCUMENTS 1,486,888 A * 3/1924 Hawley ..... F22B 17/12 122/224
5,575,244 A 11/1996 Dethier
(Continued)

FOREIGN PATENT DOCUMENTS

BE 431541 A1 1/1939
DE 432118 C 7/1926
(Continued)

OTHER PUBLICATIONS

International Search Report and Written Opinion dated Sep. 3, 2014, in corresponding International Application No. PCT/ES2014/070213.

(Continued)

*Primary Examiner* — Steven B McAllister
*Assistant Examiner* — Benjamin W Johnson
(74) *Attorney, Agent, or Firm* — Fitzpatrick, Cella, Harper & Scinto

(57) ABSTRACT

An evaporation cycle of a natural circulation steam generator. An evaporator is in flow connection with a downcomer pipe and includes a first evaporative section and a second evaporative section connected in parallel with the first evaporative section and arranged at a higher level than the first evaporative section. The evaporator cycle is not associated with another external source of motive force than heat from the gas flow to assist the flow of the water in the evaporator, and the evaporator has a vertically extending outlet collector for collecting the steam and water from the first and second evaporative sections to the riser pipe. The (Continued)

outlet collector includes a lower portion and an upper portion above the lower portion. The first evaporative section is in direct flow connection with the lower portion and the second evaporative section is in direct flow connection with the upper portion.

11 Claims, 3 Drawing Sheets

(51) Int. Cl.
*F22B 35/02* (2006.01)
*F22B 17/00* (2006.01)
*F22B 17/10* (2006.01)

(58) Field of Classification Search
USPC ..... 122/235.23, 240.3, 262
See application file for complete search history.

(56) References Cited

U.S. PATENT DOCUMENTS 5,762,031 A 6/1998 Gurevich
6,718,915 B1 * 4/2004 Albrecht ..... F22B 37/142 122/235.23
7,628,124 B2 * 12/2009 Bruckner ..... F22B 37/26 122/1 B
9,739,476 B2 * 8/2017 Shenoy ..... F22B 35/14

FOREIGN PATENT DOCUMENTS

EP 0 357 590 A1 3/1990
EP 0 752 556 A1 1/1997
EP 0 764813 A1 3/1997
FR 718185 A 1/1932
FR 1523735 A 5/1968
GB 229920 A 3/1925
GB 810900 A 3/1959

OTHER PUBLICATIONS

International Preliminary Report on Patentability completed Feb. 24, 2016, in corresponding International Patent Application No. PCT/ES2014/070213.
Korean Official Action dated Nov. 28, 2017, issued in corresponding Korean Patent Application No. 10-2016-7028615, with an English translation.
Korean Official Action dated Mar. 8, 2017, issued in corresponding Korean Patent Application No. 10-2016-7028615, with an English translation.
Trial Decision date Jun. 29, 2018, issued in corresponding South Korean Patent Application No. 10-2016-7028615.

* cited by examiner

APPARATUS THAT PROVIDES AND EVAPORATION CYCLE OF A NATURAL CIRCULATION STEAM GENERATOR IN CONNECTION WITH A VERTICAL DUCT FOR UPWARD GAS FLOW

CLAIM OF PRIORITY

This application is a U.S. national stage application of PCT International Application No. PCT/ES2014/070213, filed Mar. 21, 2014.

BACKGROUND OF THE INVENTION

Field of the Invention

The present invention relates to an evaporation cycle of a natural circulation steam generator. In more detail, the invention relates to an evaporation cycle of a natural circulation steam generator in connection with a vertical duct for upward gas flow, comprising a steam drum for feeding water to a downcomer pipe, an evaporator in flow connection with the downcomer pipe and comprising a first evaporative section and a second evaporative section connected in parallel with the first evaporative section and arranged at a higher level than the first evaporative section, each of the evaporative sections comprising multiple in parallel connected evaporation tubes comprising one substantially horizontal pass or multiple in series connected substantially horizontal passes across the vertical duct for evaporating the water to a mixture of steam and water, and a riser pipe in flow connection with the evaporator for conveying the mixture of steam and water to the drum.

Description of Related Art

A heat recovery steam generator (HRSG) can be arranged in connection with a horizontal gas flow duct or a vertical gas flow duct. The latter type, so-called a vertical HRSG, is generally advantageous, especially due to a small footprint area, efficient heat transfer, and relatively easy cleaning. A disadvantage of a conventional evaporation cycle in a vertical HRSG is that, due to horizontally extending evaporation tubes, usually, a circulation pump or other external source for a motive force is required to ensure required water flow through the evaporation tubes.

Each evaporation tube of a vertical steam generator generally comprises multiple in series connected passes across the gas duct, which collectively create a water flow that can be either parallel or countercurrent to the flow of the gas. This means that, assuming that the gas flow is upwards, the water flow is parallel to the gas flow if each in water flow direction latter horizontal pass is arranged downstream of, i.e., at a higher level than a respective in water flow direction earlier horizontal pass. Correspondingly, the water flow is countercurrent to an upward flow of gas if each in water flow direction latter horizontal pass is arranged upstream of, i.e., at a lower vertical level than a respective in water flow direction earlier horizontal pass.

European patent publication EP 0 764 813 B1 discloses an evaporation cycle of a heat recovery steam generator, without a circulation pump, comprising horizontal evaporation tubes in countercurrent flow to the hot gas stream, in which the inlet header of the evaporative section is connected to a downward loop of a downcomer pipe. This is a very simple cycle, but may not provide sufficient water circulation in all circumstances.

European patent publication EP 0 357 590 B1 and U.S. Pat. No. 5,575,244 disclose different, more complicated solutions for a heat recovery steam generator comprising horizontal evaporation tubes connected parallel to the gas flow, based on using an ejector to start natural circulation in the evaporation cycle. European patent publication EP 0 752 556 B1 discloses correspondingly a heat recovery steam generator with horizontal evaporation tubes, in which a stream of feedwater, flowing by the aid of a feedwater pump, is injected to the inlet side of the evaporation tubes to start the natural circulation.

U.S. Pat. No. 5,762,031 discloses a complicated heat recovery steam generator comprising horizontal evaporation tubes connected in parallel to the gas flow. In the steam generator, the evaporator is divided into two sections, the first one of which being directly connected to the feedwater line of the system, and the water flow therein is thus based on forced circulation with a feedwater pump. The second evaporative section is primarily based on natural circulation from a steam drum, but the outlet sides of the two evaporative sections are connected together so as to assist the natural circulation with the feedwater pump.

U.S. Pat. No. 1,486,888 discloses a steam boiler comprising a first evaporative section with inclined or partly inclined and partly vertical tubes for absorbing radiation heat in a vertical combustion chamber with upward gas flow, and a second evaporative section for absorbing convection heat with inclined tubes arranged across multiple sections of a gas path. French patent publication FR 1 523 735 A discloses a steam boiler having an evaporative section with evaporation tubes with an inclined section between horizontal end sections in a chamber for horizontal gas flow. Great Britain patent publication GB 810 900 A discloses a natural circulation steam generator comprising conventional evaporative tube bundles with multiple horizontal passes across a vertical gas flow in a pressure vessel.

An object of the present invention is to provide a simple, efficient, and reliable evaporation cycle of a natural circulation steam generator in connection with a vertical duct for upward gas flow.

A further object of the present invention is to provide an evaporation cycle of a natural circulation steam generator in connection with a vertical duct for upward gas flow, in which the evaporation cycle is not associated with an external source of motive force to assist the flow of the water in the evaporator.

SUMMARY OF THE INVENTION

According to one aspect, the present invention provides an evaporation cycle of a natural circulation steam generator in connection with a vertical duct for upward gas flow, the evaporative section comprising a steam drum for feeding water to a downcomer pipe, an evaporator in flow connection with the downcomer pipe and comprising a first evaporative section and a second evaporative section connected in parallel with the first evaporative section and arranged at a higher level than the first evaporative section, each of the evaporative sections comprising multiple in parallel connected evaporation tubes comprising one substantially horizontal pass or multiple in series connected substantially horizontal passes across the vertical duct for evaporating the water to a mixture of steam and water, and a riser pipe in flow connection with the evaporator for conveying the mixture of steam and water to the drum, wherein the evaporator cycle is not associated with another external source of motive force than heat from the gas flow to assist the flow of the water in the evaporator, and the evaporator comprises a vertically extending outlet collector for collecting the steam and water from the first and second evaporative sections to the riser pipe, wherein the outlet collector comprises a lower portion and an upper portion above the lower portion, and the first evaporative section is in direct flow connection with the lower portion and the second evaporative section is in direct flow connection with the upper portion.

In practice, a complete evaporation system usually comprises multiple evaporations cycles as described above, i.e., there may be multiple downcomer pipes, evaporators, and riser pipes. A heat recovery steam generator may comprise separate evaporation cycles at different pressure levels arranged in different height levels in the vertical duct. Each of these evaporation cycles usually comprises at least multiple evaporators arranged side by side at the same height level. It is also possible that multiple evaporators as described above are connected to the same downcomer and riser pipes, or that, for example, multiple evaporators share common inlet headers and outlet collectors. Thus, even if below are discussed different embodiments of a single evaporation cycle, the discussion is to be considered also to apply for a system having such an evaporation cycle as a portion in a larger evaporation system.

An important feature of the current evaporation cycle is that the cycle is not associated with another external source of motive force than heat from a stream of hot gas in the vertical duct to assist the water flow in the evaporator. This means that the evaporation cycle does not include any external equipment or measures, apart from gravitation and heat from a hot gas, to start or to maintain the water flow. Thus, the evaporation cycle does not include, for example, a circulation pump, an ejector pump or injection of feedwater propelled by a feedwater pump.

According to the present invention, the evaporator is divided into two evaporative sections that are arranged so that the first evaporative section is at a lower level than the second evaporative section. Thus, the first evaporative section can also be called the lower evaporative section and the second evaporative section can be called the upper evaporative section. The first and second evaporative sections are connected in parallel, i.e., both sections are fed directly by the downcomer pipe.

The arrangement for effecting water circulation according to the present invention includes that the evaporator comprises a vertically extending outlet collector, advantageously, a vertically arranged elongated chamber, for collecting the steam and water from the first and second evaporative sections to the riser pipe. The outlet collector comprises a lower portion and an upper portion above the lower portion, and the first evaporative section is attached to the lower portion and the second evaporative section is attached to the upper portion.

The advantageousness of the present arrangement is based on the observation of the inventors that the lower evaporative section, which is heated by the initial hot gas flow, creates a relatively large amount of steam to be collected to the lower portion of the vertically extending outlet collector. The collected steam then rises in the outlet collector and combines with steam and hot water collected from the upper evaporative section to the upper portion of the outlet collector. The formed mixture of steam and hot water flows from the outlet collector to a conventional riser pipe connected to a top portion of the outlet collector, and then, through the riser pipe back to the drum.

The upper and lower evaporative sections comprise multiple in parallel connected evaporation tubes for heating the water so as to generate a mixture of steam and water. Each evaporation tube comprises one or more substantially horizontal passes across the vertical duct. Thus, heat is transferred from the gas to the water in the evaporation tubes either in a single substantially horizontal pass or in multiple in series connected substantially horizontal passes.

According to the present invention, evaporation tubes comprising multiple substantially horizontal passes are arranged with water flow parallel to the gas stream. This means that the in series connected horizontal passes are arranged so that each in water flow direction latter horizontal pass is arranged at a higher level than any in water flow direction earlier horizontal pass. Thus, the in series connected horizontal passes of an evaporation tube are arranged so that the overall water flow is parallel with the flow of gas.

According to a preferred embodiment of the present invention, each evaporation tube of the lower evaporative section comprises only a single pass across the vertical duct. Thereby, the friction of water flow in the evaporation tubes of the lower evaporative section is especially low, and the driving force caused by the pressure difference between a water column in the downcomer pipe and the column of steam and water in the vertically extending outlet collector and in the riser pipe is high enough to effect sufficient water circulation, even in start-up and low load conditions.

Generally, the first and the second evaporative sections comprise an inlet header. The inlet headers are advantageously vertically arranged elongated chambers, and the downcomer pipe is connected to a bottom portion of each of the inlet headers. The downcomer pipe is advantageously connected to the inlet headers by respective downcomer extensions, or feeder pipes. Advantageously, each feeder pipe forms a downwards extending loop, which is, in operation, filled with water and prevents steam from flowing backwards to the downcomer pipe.

According to a preferred embodiment of the present invention, the inlet header of the upper evaporative section is arranged at a higher level than the lower portion of the outlet collector and at a lower level than the upper portion of the outlet collector. Thereby, the upper evaporative section is completely at a higher level than the lower evaporative section.

According to a preferred embodiment of the present invention, each evaporation tube of the upper evaporative section comprises two passes across the vertical duct. Thereby, when the evaporation tubes of the lower evaporation section comprise only a single pass across the vertical duct, the inlet headers of the lower and upper evaporative sections are on opposite sides of the vertical duct.

When the evaporation tubes of the lower evaporative section comprise only a single horizontal pass, the inlet header of the lower evaporative section is generally arranged at the same height level as the lower portion of the outlet collector. In practice, the horizontal passes of the upper and lower evaporative sections do not have to be absolutely horizontal, but they may be slightly slanted upwards, for example, by up to 2%. The portions of the evaporation tubes connecting two consecutive in series connected horizontal portions of the second evaporative section are generally mainly vertical and arranged outside of the gas duct. Moreover, the connections of the evaporation tubes to the inlet headers and outlet collectors may comprise an in water flow direction upwards bent part.

The evaporation tubes of both of the evaporative sections are generally arranged as a set of tubes arranged one on top of the other. Generally, the order of tubes in each set of evaporation tubes is reversed in each turn, outside of the gas duct, between consecutive passes. In practice, it is common that multiple, usually, three or four, sets of evaporation tubes of respective evaporative sections are connected in single inlet headers and outlet collectors. Thereby, a complete evaporation system may also comprise side by side arranged sets of evaporation tubes connected to the same inlet headers and outlet collectors.

The above brief description, as well as further objects, features, and advantages of the present invention will be more fully appreciated by reference to the following detailed description of the currently preferred, but nonetheless illustrative, embodiments in accordance with the present invention, when taken in conjunction with the accompanying drawings.

DETAILED DESCRIPTION OF THE INVENTION

Figure 1:
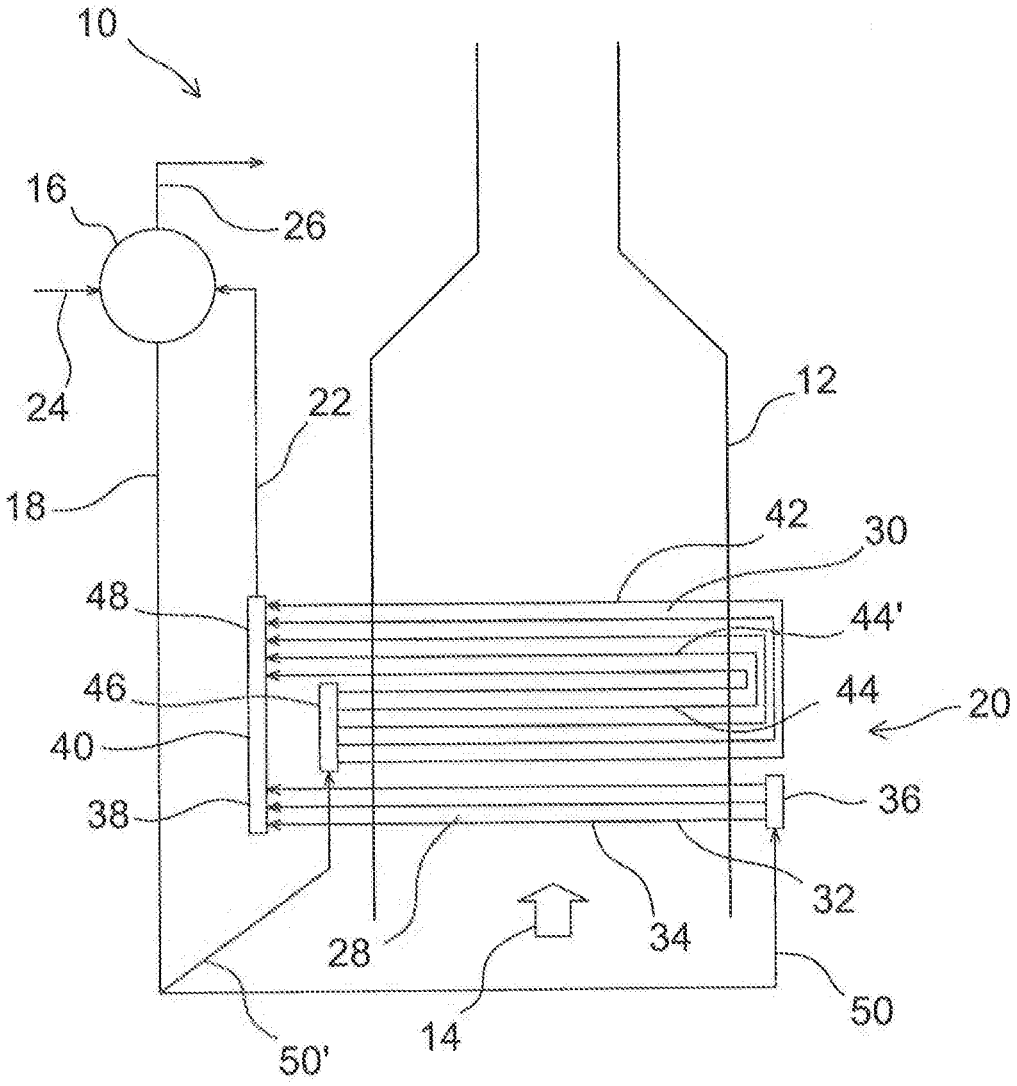
FIG. 1 shows a schematic diagram of an evaporation cycle in accordance with a first embodiment of the present invention.

FIG. 1 schematically shows an evaporation cycle 10 of a natural circulation heat recovery steam generator (HRSG) according to a preferred embodiment of the present invention. The evaporation cycle 10 is arranged in connection with a vertical duct 12 for an upward flow of hot gas 14, such as exhaust gas from a gas turbine. The evaporation cycle 10 comprises a steam drum 16 for feeding water to a downcomer pipe 18, an evaporator 20 in flow connection with the downcomer pipe 18 for evaporating the water to a mixture of steam and water, and a riser pipe 22 in flow connection with the evaporator 20 for conveying the mixture of steam and water to the stream drum 16. Also, a feedwater line 24 for introducing fresh water to the steam drum 16 and a steam line 26 for discharging steam from the steam drum 16 are connected to the steam drum 16.

The evaporator 20 comprises a first evaporative section 28 and a second evaporative section 30 that are connected in parallel, i.e., the first and second evaporative sections 28 and 30 are in direct flow connection to the downcomer pipe 18. The first evaporative section 28 is arranged below the second evaporative section 30, which means that the first evaporative section 28 is arranged in the gas stream 14 upstream of the second evaporative section 30. The first, or lower, evaporative section 28 comprises multiple in parallel connected evaporation tubes 32, each of which makes a single horizontal pass 34 across the vertical duct 12 from an inlet header 36 to a lower portion 38 of an outlet collector 40. Correspondingly, multiple in parallel connected evaporation tubes 42 of the second, or upper, evaporative section 30 make two horizontal passes 44, 44' across the vertical duct 12 from an inlet header 46 to an upper portion 48 of the outlet collector 40. The second evaporative section 30 is connected parallel to the gas flow 14, i.e., the second horizontal pass 44' is arranged in the gas stream downstream of, or at a higher level than, the first horizontal pass 44. The evaporation tubes 32, 42 are usually finned tubes but, for the sake of simplicity, this is not shown in FIG. 1.

According to the present invention, the first mixture of steam and water collecting to the lower portion 38 of the outlet collector 40 flows through the lower evaporative section 28, due to the single pass configuration, with very low friction. Therefore, even a relatively low pressure difference between the fluid columns upstream and downstream of the first evaporative section, i.e., the difference of the hydrostatic pressure of water in the downcomer pipe 18 and that of the mixture of steam and water in the riser pipe 22 and in the outlet collector 40, brings about an intense flow of water through the lower evaporative section 28. The first mixture flows from the lower portion 38 of the outlet collector 40 upwards and combines with a second mixture of steam and water, formed in the second evaporative section 30, and acts as an internal ejector pump for the second mixture and assures a sufficient flow velocity of the combined mixture of steam and water. Based on the advantage described above, an evaporator cycle according to the present invention does not need any other source of motive force than heat from the stream of hot gas to assist the flow of the water in the evaporator.

The outlet collector 40 can be of different vertically extending shapes, comprising a lower portion and an upper potion, but advantageously, it is a vertically arranged elongated chamber. The riser 22 is connected to a top portion of the outlet collector 40, or, in practice, it can be a direct extension of the outlet collector.

The inlet headers 36, 46 of the first and second evaporative sections 28 and 30, which distribute water from the downcomer pipe 18 to the multiple in parallel connected evaporation tubes 32, 42, respectively, are advantageously vertically arranged elongated chambers. The downcomer pipe is preferably connected to a bottom portion of each of the inlet headers 36, 46, by pipe sections 50, 50' extending below the inlet headers, respectively.

Because the first evaporative section 28 comprises only a single substantially horizontal pass 34 across the vertical duct 12, the inlet header 36 of the first evaporative section is arranged substantially at the same height level as the lower portion 38 of the outlet collector 40. In practice, the substantially horizontal pass may be slightly slanted, typically, by at most two degrees, and connection tube sections between the evaporation tubes and the inlet headers and outlet collectors, respectively, may be slightly bent. Therefore, the bottom section 38 of the outlet collector 40 may be at a somewhat higher level than the inlet header 36.

Because the second evaporative section 30 is arranged parallel to the gas flow 14 and comprises two substantially horizontal passes 44, 44' across the vertical duct 12, the inlet header 46 of the second evaporative section is naturally at a lower level than the upper portion 48 of the outlet collector 40. Moreover, because the second evaporative section 30 is at a higher level than the first evaporative section 28, the inlet header 46 of the second evaporative section 30 is advantageously at a higher level than the lower portion 38 of the outlet collector 40 and at a lower level than the upper portion 48 of the outlet collector 40.

Figure 2:
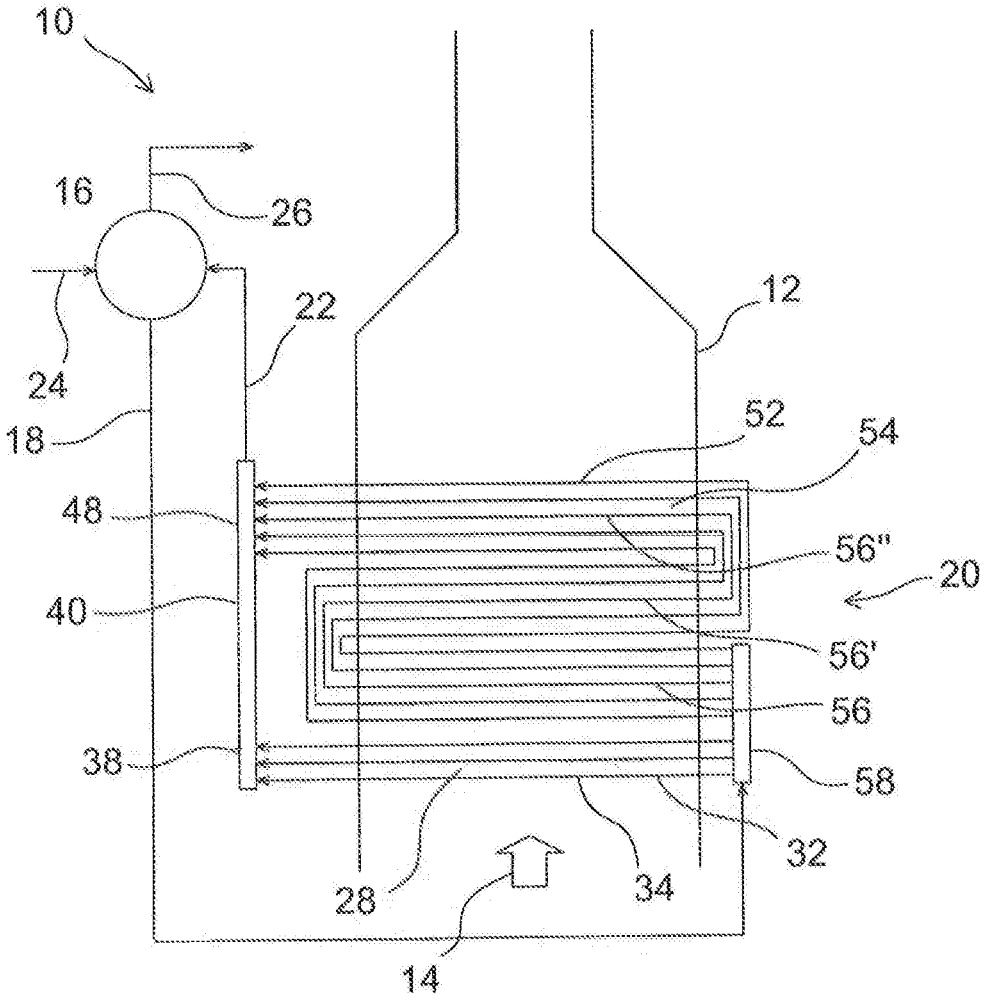
FIG. 2 shows a schematic diagram of another evaporation cycle in accordance with a second embodiment of the present invention.

FIG. 2 schematically shows an evaporation cycle 10 of a natural circulation heat recovery steam generator (HRSG) according to another preferred embodiment of the present invention. The elements in FIG. 2 that are identical with the corresponding elements in FIG. 1 are denoted by the same reference numbers as those in FIG. 1.

The embodiment of FIG. 2 differs from that in FIG. 1 mainly in that the evaporation tubes 52 of the second evaporative section 54 make three substantially horizontal passes 56, 56', 56" across the vertical tube 12. Due to the three passes, more steam is produced in the second evaporative section of FIG. 2 than in that of the embodiment in FIG. 1. Because of the increased length and number of turns in the evaporation tubes, however, the friction of the fluid flow is increased, and there is an increased need for assisting the flow of the mixture of steam and water by the flow from the first evaporative section. Therefore, as in the embodiment shown in FIG. 1, the first and second evaporative sections 28, 54 have a common outlet collector 40, whereby the intense stream of steam and water from the first evaporative section 28 combines with the corresponding stream from the second evaporative section 54 and assures in all conditions a sufficient flow velocity of the combined mixture of steam and water.

The inlet ends of the evaporation tubes of the first and second evaporative sections 28, 54 are, in the embodiment of FIG. 2, on the same side of the vertical duct 12. Therefore, the first and second evaporative sections 28, 54 may have a common inlet header 58, advantageously, a vertically arranged elongated chamber.

Figure 3:
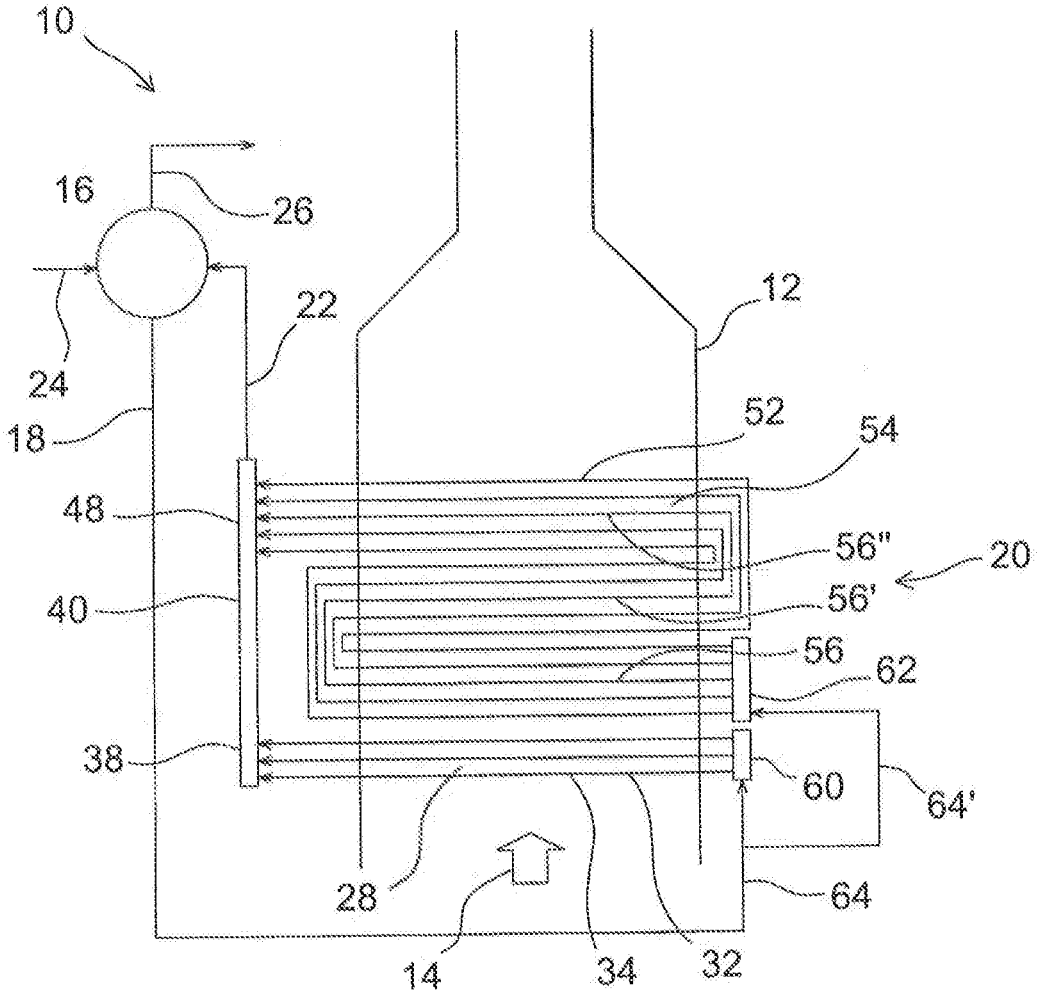
FIG. 3 shows a schematic diagram of an evaporation cycle in accordance with a third embodiment of the present invention.

FIG. 3 shows a third embodiment of the present invention that differs from that of FIG. 2 only in that, instead of a common inlet header, the first and second evaporative sections 28, 54 have separate inlet headers, 60, 62, respectively. The inlet headers 60, 62 are connected to the downcomer pipe 18 by pipe sections, 64, 64', respectively.

FIGS. 1 to 3 schematically show a vertical cross section of an evaporation cycle of a heat recovery steam generator (HRSG). In practice, a complete evaporation cycle extends through the depth of the vertical duct, and the upper and lower evaporative sections are multiplied correspondingly. Usually, about three or four upper and lower evaporative sections share common inlet headers and outlet collectors. Usually, there are also multiple inlet headers and outlet collectors, which may share common downcomer and riser pipes, or there may be multiple downcomer and riser pipes connected to single or multiple inlet headers and outlet collectors.

It should be understood that the invention is described by way of examples in connection with what are at present considered to be the preferred embodiments, but it is intended to cover various combinations of its features and other applications within the scope of the invention as defined in the appended claims. Described is an embodiment in which only one evaporative section is divided into upper and lower evaporative sections. It should be understood, however, that there can be plurality of evaporative sections that are divided into upper and lower evaporative sections. In addition, a plurality of steam drums can be considered.

The invention claimed is:

1. An apparatus that provides an evaporation cycle of a natural circulation steam generator in connection with a vertical duct for upward gas flow, the apparatus comprising:

(A) a steam drum for feeding water to a downcomer pipe;

(B) an evaporator in flow connection with the downcomer pipe, the evaporator comprising (i) a first evaporative section arranged at a first level and (ii) a second evaporative section, connected in parallel with the first evaporative section and arranged at a second level that is a higher level than the first level of the first evaporative section, wherein the first evaporative section and the second evaporative section are connected to a common inlet header, and wherein each of the first and second evaporative sections comprising multiple, in parallel connected, evaporation tubes for evaporation of the water to generate a mixture of steam and water;

(C) a riser pipe in flow connection with the evaporator for conveying the mixture of steam and water to the steam drum; and (D) a vertically extending outlet collector for collecting the steam and water from the first and second evaporative sections and for feeding the collected steam and water to the riser pipe, the outlet collector comprising a lower portion and an upper portion above the lower portion, wherein (a) each evaporation tube of the first evaporative section makes a single, substantially horizontal pass across the vertical duct from the common inlet header to the lower portion of the outlet collector, (b) each evaporation tube of the second evaporative section makes three, in series connected, substantially horizontal passes across the vertical duct from the common inlet header to the upper portion of the outlet collector, such that at least one of the substantially horizontal passes across the vertical duct of each evaporation tube of the second evaporative section is arranged (i) downstream, in the gas flow, from a second of the substantially horizontal passes across the vertical duct of each evaporation tube of the second evaporative section, and (ii) at a higher level than the second of the substantially horizontal passes across the vertical duct of each evaporation tube of the second evaporative section, and (c) the evaporation cycle of the natural circulation steam generator provided by the apparatus is not associated with another external source of motive force, other than heat from the gas flow, to assist the evaporation of the water in the evaporator.

2. The apparatus according to claim 1, wherein the outlet collector is a vertically arranged elongated chamber.

3. The apparatus according to claim 2, wherein the riser pipe is connected to a top portion of the outlet collector.

4. The apparatus according to claim 1, wherein the common inlet header is arranged at the same height level as that of the lower portion of the outlet collector, and at a lower level than the upper portion of the outlet collector.

5. The apparatus according to claim 4, wherein the common inlet header is a vertically arranged elongated chamber, and the downcomer pipe is connected to a bottom portion of the common inlet header.

6. The apparatus according to claim 4, wherein the in series connected, substantially horizontal passes of each evaporation tube of the second evaporative section are arranged so that overall fluid flow is parallel with the gas flow.

7. The apparatus according to claim 1, wherein the common inlet header is arranged at the same height level as that of the lower portion of the outlet collector.

8. The apparatus according to claim 7, wherein the common inlet header is a vertically arranged elongated chamber, and the downcomer pipe is connected to a bottom portion of the common inlet header.

9. The apparatus according to claim 1, wherein the common inlet header is a vertically arranged elongated chamber, and the downcomer pipe is connected to a bottom portion of the common inlet header.

10. The apparatus according to claim 1, wherein the substantially horizontal pass of each evaporation tube of the first evaporative section is one of (i) horizontal and (ii) slanted upwards by at most two degrees.

11. The apparatus according to claim 1, wherein each substantially horizontal pass of each evaporation tube of the second evaporative section is one of (i) horizontal and (ii) slanted upwards by at most two degrees.

* * * * *